United States Patent [19]

Anner et al.

[11] 4,268,223

[45] May 19, 1981

[54] VIBRATION SUPRESSION FOR TURBINE BLADES

[75] Inventors: Emil Anner, Neuenhof; Harry Brunner, Fislisbach; Hans J. Meister, Wettingen, all of Switzerland

[73] Assignee: BBC Brown, Boveri & Co., Ltd., Baden, Switzerland

[21] Appl. No.: 942,143

[22] Filed: Sep. 14, 1978

[30] Foreign Application Priority Data

Sep. 14, 1977 [CH] Switzerland ..... 11220/77

[51] Int. Cl.[3] ..... F01D 5/24

[52] U.S. Cl. ..... 416/196 R; 416/500

[58] Field of Search ..... 416/196 R, 500

[56] References Cited

FOREIGN PATENT DOCUMENTS 518519 2/1931 Fed. Rep. of Germany ..... 416/196
950294 10/1956 Fed. Rep. of Germany ..... 416/196
381873 10/1932 United Kingdom ..... 416/196
708836 5/1954 United Kingdom ..... 416/196
943023 11/1963 United Kingdom ..... 416/196

*Primary Examiner*—Everette A. Powell, Jr.
*Attorney, Agent, or Firm*—Burns, Doane, Swecker & Mathis

[57] ABSTRACT

A method and apparatus for suppressing vibration in turbine blading and the like is disclosed. A damping tube is inserted through an aperture in each of a plurality of turbine blades. By expanding the damping tube after it is inserted in the blades the tube is firmly secured to each blade. A wire may be inserted through the damping tube and is secured by crimping the expanded tube portions. The tube may be divided into circumferential segments with each tube being widened for example by means of a center punch at an end portion which extends through the final blade of each segment.

3 Claims, 4 Drawing Figures

VIBRATION SUPRESSION FOR TURBINE BLADES

BACKGROUND AND SUMMARY OF THE PRESENT INVENTION

The present invention relates generally to vibration suppression for turbine blades.

Various types of vibration suppressors are known to be used for the blades of both steam and gas turbines and for compressors and the like. Since the individual blades need to be fastened at one end to a rotor, vibration suppressors are employed in order to eliminate the danger of fractures due to vibrations. Prior techniques for reducing vibration consist of soldering a wire into the blades, inserting damping rods within the individual blades, or riveting or soldering tierods to the blades.

The known turbine blade vibration suppressors have various disadvantages especially when used in gas turbines which have a high output and that operate at high temperatures. For example, a soldered damping wire cannot be used in an engine having high operating temperatures because the solder might melt. Damping rods which are inserted into the blades and have a certain amount of play will eventually result in wear of both the rods and the blade openings so that the damping effect will be lost.

Accordingly, it is an object of the present invention to provide a vibration suppressor for a turbine which is attached to blades of the turbine in a simple manner and which effectively reduces vibrations within the turbine blades.

The present invention accomplishes these and other objects in that the damping elements for the turbine blades include damping tubes which are expanded between the individual adjacent turbine blades. Wires are inserted in the tubes axially with respect to the longitudinal axis of each tube to further stabilize the damping tube, especially in turbines in which the blades are spaced relatively far apart.

The vibration suppressor of the present invention has a particular advantage over the prior art in that expansion of the damping tubes between the turbine blades will prevent a shifting of the damping tube. By maintaining the damping tube in a proper position the turbine blades are in turn retained in their proper position, thus making it possible to reduce vibrations to a minimum.

Another feature of the present invention provides for crimping of the expanded portions of the tube to secure the wire which is inserted through the tube. Additionally, an end portion of the damping tube which extends through the last blade of each circumferential segment is expanded to securely fix the tube with respect to the final blade.

The crimping of the wires at the expanded portions of the damping tubes prevents the wire, which is inserted into the damping tubes, from moving within the tube. Since the damping tubes are employed across the perimeter of a row of blades or buckets, the damping tube must be widened at the final blade, preferably by a center punch, so as to secure the tube to the last blade.

BRIEF DESCRIPTION OF THE DRAWINGS

A preferred embodiment of the present invention will be described with reference to the accompanying drawings wherein like reference numerals refer to like members and wherein.

DESCRIPTION OF THE PREFERRED EMBODIMENT

Figure 1:
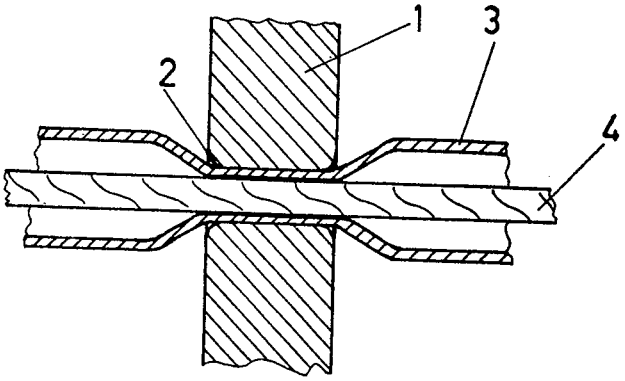
FIG. 1 is a cross-sectional view of a turbine blade having a damping tube with a wire inserted therein according to the present invention.

With reference to FIG. 1, a turbine blade 1, for example an entrance blade, is provided with an aperture 2 through which a vibration suppressor, preferably a damping tube 3, is inserted. The damping tube 3 is expanded after insertion through the turbine blade by means of an internal pressure which is provided, for example, by a hydraulic fluid. The expansion increases the diameter of the damping tube 3 relative to the diameter of the aperture 2 in the turbine blade 1 in the portions extending between the turbine blades 1. The expanded portion thereby secures the damping tube 3 within each turbine blade 1. A wire 4 having a diameter which is slightly smaller than the internal diameter of the damping tube 3 may be inserted along the longitudinal axis of the damping tube 3, preferably after the tube has been expanded to provide for increased stability of the tube. The wire is closely received within the portion of the tube seated in the aperture to retain the wires in place.

The damping tube alone may be sufficient to provide suppression of vibrations of the turbine blades. The wire 4 is not essential to provide the desired vibration suppression but is included to increase the stability of the tubes.

Figure 2:
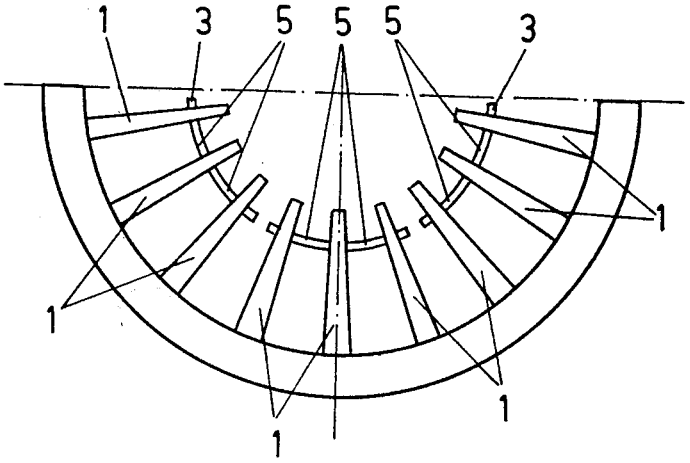
FIG. 2 is a side view of a blade ring including a plurality of the vibration suppressors as in FIG. 1.

Since movement of the damping tube 3 is restricted within the aperture 2 of the turbine blade 1, a thermal expansion of the tube is limited. To permit thermal expansion of the tube, therefore, the arch of the tube is divided into a plurality of individual segments 5 (see FIG. 2). It is advantageous both to expand the damping tube 3 between the turbine blades 1 and to insert the wire 4 into the tube prior to dividing the tube into the individual segments 5.

Figure 3:
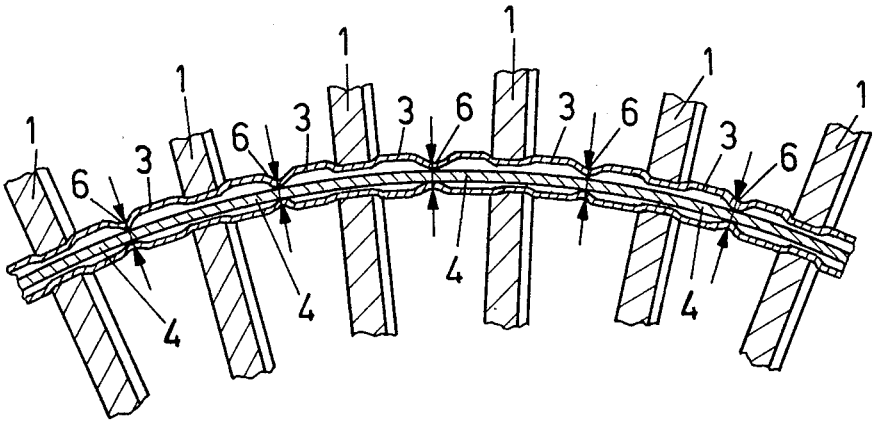
FIG. 3 is a cross-sectional view of a blade ring having a modified form of damping tube which is crimped in portions extending between the blades.

With reference now to FIG. 3, in order to avoid any shifting or fluttering of the wire 4 within the damping tube 3, it is preferable to crimp the expanded portions of the tube which extend between the blades, as indicated by the arrows at 6. The crimped portions 6 are provided between the turbine blades 1 so as to secure the wire 4 within the tube 3. It should be noted, however, that the wire 4 is closely received within the portion of the tube seated in the aperture of the blade 1 in the same manner as illustrated in FIG. 1.

Figure 4:
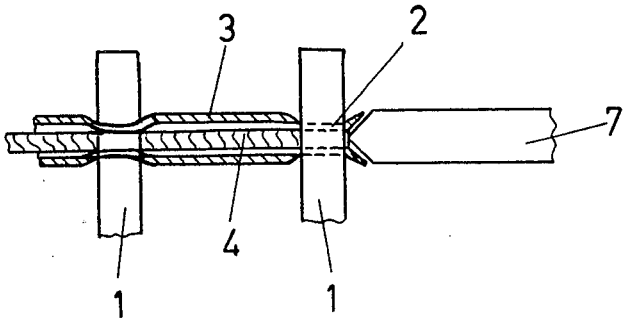
FIG. 4 is a cross-sectional view of the end portion of a damping tube segment showing the expansion of an end of the damping tube to secure it in the last blade.

With reference now to FIG. 4, the portion of the damping tube 3 which extends through the final aperture 2 is enlarged at the last or final blades 1 of each damping tube segment 5 of the turbine ring. The tube is enlarged preferably by a center punch 7 which is inserted axially into the end of the tube. The widening of the end of the tube insures that the final turbine blade 1 of each segment is maintained in a proper position by the damping tube.

The above-described design of a vibration suppressor, as proposed by the present invention, makes it possible to stabilize the turbine blades, the entrance blades and the buckets of a turbomachine and to reduce the vibration of the turbine blades in a relatively simple manner. Individual segments of the vibration suppressor of the present invention can be readily replaced if repairs need to be performed at a later date.

The principles, preferred embodiments and methods of operation of the present invention have been described in the above specification. The invention which is intended to be protected is not, however, to be limited to the particular forms disclosed, which are merely illustrative and not restrictive examples. Variations and changes may be made by those skilled in the art without departing from the nature and scope of the present invention.

What is claimed is:

1. In a turbine or compressor of the type having stator and rotor members formed with adjacent radial blades arranged in a row about a central axis of the turbine or compressor, a vibration suppressed blade arrangement comprising:

a damping tube including a plurality of curved damping tube segments which extend through a plurality of blades arranged in a blade ring;

at least two adjacent blades having apertures therein, the damping tube extending through and being both closely and directly received by said apertures and having a thickness adjacent said apertures that is greater than the size of said apertures to securely position the damping tube with respect to said blades, each of the damping tube segments including enlarged end portions which are provided in close proximity to a respective one of the apertures of one of the blades, said enlarged end portions being wider than the size of the respective one of the apertures to securely position the tube segment with respect to the one blade; and a wire extending through the damping tube, the wire including a plurality of wire segments, each wire segment extending through a corresponding one of said curved damping tube segments along a longitudinal axis of the damping tube, the wire being secured to the damping tube intermediate adjacent blades of the blade ring.

2. The arrangement according to claim 1 wherein said damping tube is secured to the wire by crimps provided in the damping tube between adjacent blades of the blade ring and further wherein the wire is closely received within the damping tube at the apertures of the at least two adjacent blades.

3. The arrangement according to claim 1 wherein the damping tube has a diameter between adjacent blades which is substantially greater than the diameter of the wire.

* * * * *